US007810549B2

(12) United States Patent
Li et al.

(10) Patent No.: US 7,810,549 B2
(45) Date of Patent: Oct. 12, 2010

(54) ADAPTIVE AND UNIVERSAL HOT RUNNER MANIFOLD FOR DIE CASTING

(75) Inventors: Naiyi Li, Ann Arbor, MI (US); Nanda Gopal, Troy, MI (US)

(73) Assignees: Ford Global Technologies, LLC, Dearborn, MI (US); Intermet Corporation, Troy, MI (US)

( * ) Notice: Subject to any disclaimer, the term of this patent is extended or adjusted under 35 U.S.C. 154(b) by 66 days.

(21) Appl. No.: 11/620,301

(22) Filed: Jan. 5, 2007

(65) Prior Publication Data

US 2008/0164290 A1 Jul. 10, 2008

(51) Int. Cl.
*B22D 17/04* (2006.01)

(52) U.S. Cl. ..... 164/316; 164/113; 425/547

(58) Field of Classification Search ..... 164/135, 164/316, 133, 244, 306–318; 425/573
See application file for complete search history.

(56) References Cited

U.S. PATENT DOCUMENTS

| | | | | |
|---|---|---|---|---|
| 1,964,324 | A | 6/1934 | Korsmo | |
| 3,270,383 | A | 9/1966 | Hall et al. | |
| 3,652,073 | A | 3/1972 | Lewis | |
| 4,408,651 | A | 10/1983 | Smedley et al. | |
| 4,690,198 | A | 9/1987 | Hardey et al. | |
| 5,295,806 | A * | 3/1994 | Gunther | 425/547 |
| 5,299,623 | A | 4/1994 | Yaffe et al. | |
| 5,983,979 | A * | 11/1999 | Miki | 164/316 |
| 6,305,923 | B1 | 10/2001 | Godwin et al. | |
| 6,405,784 | B2 | 6/2002 | Takizawa et al. | |
| 6,405,785 | B1 | 6/2002 | Gellert et al. | |
| 6,634,412 | B1 | 10/2003 | Murray et al. | |
| 6,745,821 | B1 * | 6/2004 | Wilson | 164/342 |
| 2002/0121355 | A1 | 9/2002 | Bigler et al. | |
| 2004/0144516 | A1 * | 7/2004 | Liu | 164/113 |
| 2005/0226956 | A1 * | 10/2005 | Fischer et al. | 425/549 |
| 2005/0238748 | A1 * | 10/2005 | Jenko | 425/190 |
| 2005/0255189 | A1 * | 11/2005 | Manda et al. | 425/567 |
| 2006/0228442 | A1 * | 10/2006 | Fischer et al. | 425/572 |

* cited by examiner

*Primary Examiner*—Jessica L Ward
*Assistant Examiner*—Kevin E Yoon
(74) *Attorney, Agent, or Firm*—Raymond L. Coppiellie; Brooks Kushman P.C.

(57) ABSTRACT

A method and apparatus for the casting of metal components is disclosed. The apparatus includes a plunger for drawing molten metal from a crucible of hot metal and for forcing the drawn molten metal through the system, a hot runner assembly having a nozzle tip positioned adjacent the mold cavity, and a machine nozzle disposed between the plunger and the hot runner assembly. An adaptive and universal hot runner manifold having removable hot runner injectors fitted thereto is provided for use with a variety of castings.

20 Claims, 8 Drawing Sheets

ADAPTIVE AND UNIVERSAL HOT RUNNER MANIFOLD FOR DIE CASTING

GOVERNMENT CONTRACT INFORMATION

This invention was made with United States Government support awarded by the following program, agency and contract: NIST Advanced Technology Program, the United States Department of Commerce, Contract No. 70NANBOH3053. The United States has certain rights in this invention.

TECHNICAL FIELD

Magnesium is an attractive material for application in motor vehicles because it is both a strong and lightweight material. The use of magnesium in motor vehicles is not new. Race driver Tommy Milton won the Indianapolis 500 in 1921 driving a car with magnesium pistons. A few years after that magnesium pistons entered mainstream automotive production. By the late 1930's over 4 million magnesium pistons had been produced. Even in the early days of car production, the weight-to-strength ratio of magnesium, compared with other commonly-used materials, was well-known.

Considering the recent increase in fuel prices driven largely by increased global demand, more attention is being given to any practical and economically viable step that can be taken to reduce vehicle weight without compromising strength and safety. Accordingly, magnesium is increasingly becoming an attractive alternative to steel, aluminum and polymers, given its ability to simultaneously meet crash-energy absorbing requirements while reducing the weight of vehicle components. Having a density of 1.8 kg/L, magnesium is 36% lighter per unit volume than aluminum (density=2.70 kg/L) and is 78% lighter per unit volume than steel (density=7.70 kg/L). Magnesium alloys also hold a competitive weight advantage over polymerized materials, being 20% lighter than most conventional glass reinforced polymer composites.

Beyond pistons, numerous other vehicle components are good candidates for being formed from magnesium, such as inner door panels, dashboard supports and instrument panel support beams. In the near-term it is anticipated that components made from magnesium for high volume use in the motor vehicle might also include powertrain, suspension and chassis components.

The fact that the surface "skin" of die-cast magnesium has better mechanical properties over the bulk than more commonly used materials, thinner (ribbed) and lighter die-castings of magnesium can be produced to meet their functional requirements. Such components can have sufficiently high strength per unit area to compete with more common and heavier aluminum and plastic components. Furthermore, magnesium has considerable manufacturing advantages over other die-cast metals, such as aluminum, being able to be cast closer to near net-shape thereby reducing the amount of material and associated costs. Particularly, components can be routinely cast at 1.0 mm to 1.5 mm wall thickness and 1 to 2 degree draft angles, which are typically ½ that of aluminum. The extensive fluid flow characteristics of magnesium offers a single, large casting to replace a plurality of steel fabrications. Magnesium also has a lower latent heat and reduced tendency for die pick-up and erosion. This allows a reduced die-casting machine cycle time (~25% higher productivity) and 2 to 4 times longer die life (from 150-200,000 to 300-700,000 shots) compared with that of aluminum casting.

However, the use of magnesium in automotive components is burdened with certain drawbacks. While magnesium is abundant as a natural element, it is not available at a level to support automotive volumes. This situation causes hesitation among engineers to design and incorporate magnesium components. On the occasion when the magnesium is selected as the material of choice, designers fail to integrate die-casting design with manufacturing feasibility in which the mechanical properties, filling parameters, and solidification profiles are integrated to predict casting porosity and property distribution.

The raw material cost of magnesium relative to other commonly used materials is also an impediment to mass implementation in the automotive industry. Current techniques for casting parts from magnesium make expanding the use of magnesium into a broader array of products less attractive. Presently, all large die-castings are produced in high pressure, cold-chamber machines where the metal is injected from one central location. This approach results in inferior material properties and waste material.

Accordingly, in order to make the use of magnesium in the production of vehicle components more attractive to manufacturers, a new approach to product casting is needed. This new approach is the focus of the apparatus set forth herein.

SUMMARY OF THE INVENTION

The adaptive and universal hot runner manifold disclosed herein finds utility in the casting of metal components in a die that is part of a metal casting apparatus. The hot runner manifold includes an inlet, two or more outlets, and a passageway that fluidly connects the inlet and the outlets. Either a hot runner injector or a metallic plug can be inserted into the outlets, the selection of one over the other depending on the design configuration of the die tool and casting. The hot runner injectors, usually in the form of straight cylinders, may have different dimensions, with a certain dimension being selected again based on the configurations of the die and casting.

A molten metal delivery component, such as a gooseneck having a shot plunger that is movable between a molten metal drawing position and a molten metal injection position, is at least partially disposed in a crucible of molten metal. The gooseneck has an inlet and an outlet. The inlet of the gooseneck is in fluid communication with the crucible. The outlet of the gooseneck is in fluid communication with the inlet of a machine nozzle. The outlet of the machine nozzle is in fluid communication with the inlet of the hot runner manifold. The hot runner manifold is in fluid communication with the mold cavity of the die by the hot runner injectors.

In operation, the user initially determines whether a hot runner injector or a plug should be inserted into the manifold outlet based upon the configurations of the die and casting. If a hot runner injector is selected, the user also selects an injector of a certain length, also as dictated by the configuration of the die. The hot runner manifold is fluidly connected with the die and with the machine nozzle. Molten metal is then drawn into the gooseneck from the crucible. The drawn molten metal is then injected from the gooseneck into and through the adaptive and universal hot runner manifold and into the mold cavity.

Other features of the apparatus and method disclosed herein will become apparent when viewed in light of the detailed description of the preferred embodiment when taken in conjunction with the attached drawings and the appended claims.

BRIEF DESCRIPTION OF THE DRAWINGS

For a more complete understanding of the adaptive and universal hot runner manifold for die casting set forth herein, reference should now be made to the embodiments illustrated in greater detail in the accompanying drawings and described below wherein.

DETAILED DESCRIPTION OF THE PREFERRED EMBODIMENTS

Figure 1:
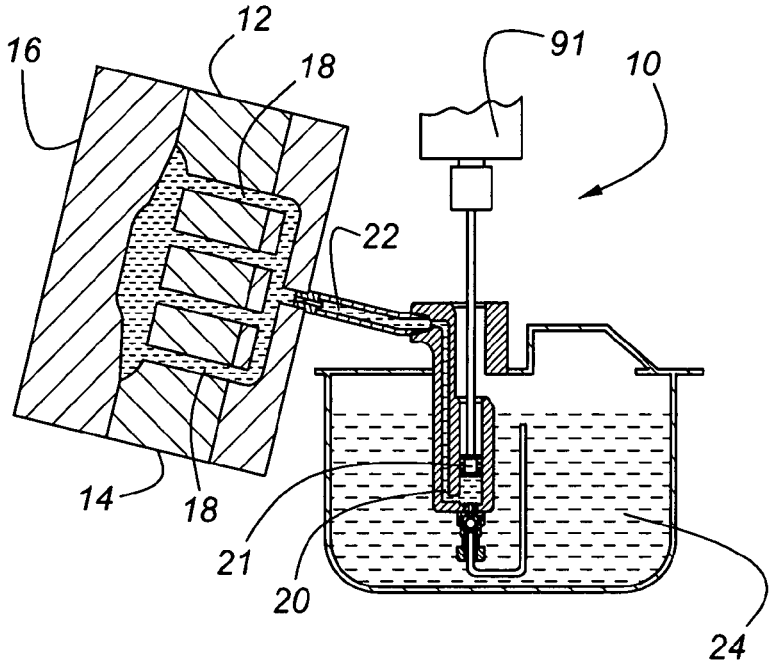
FIG. 1 illustrates a diagrammatic view of a casting apparatus utilizing the adaptive and universal hot runner manifold described herein.

In the following figures, the same reference numerals will be used to refer to the same components. In the following description, various operating parameters and components are described for various constructed embodiments. These specific parameters and components are included as examples and are not meant to be limiting.

With reference to FIG. 1, a diagrammatic view of the present hot chamber apparatus is illustrated, being generally identified as 10. The apparatus 10 is entirely self-enclosed, preventing atmospheric exposure of the liquid melt. It is to be understood that while the illustrated apparatus is directed at the formation of components from molten magnesium alloy, other metals including zinc may be used.

The hot chamber 10 includes a casting die 12. The casting die 12 includes a cover half 14 and an ejector half 16, a plurality of hot runner assemblies 18 partially recessed within the cover half 14 of the casting die 12, a gooseneck 20, a shot plunger 21 operatively associated with the gooseneck 20, and a machine nozzle 22 fitted between the hot runner assembly 18 and the gooseneck 20. A substantial portion of the gooseneck 20 is submerged within a crucible 24 of molten metal.

Figure 2:
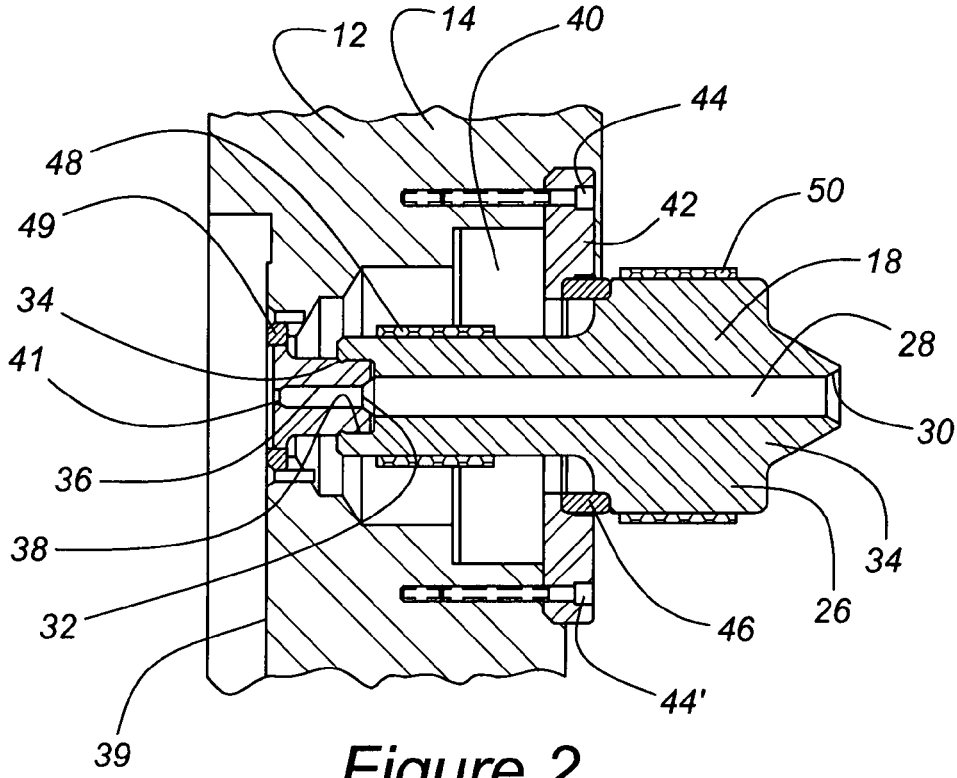
FIG. 2 illustrates a sectional view of a hot runner assembly in position relative to a die.
Figure 5:
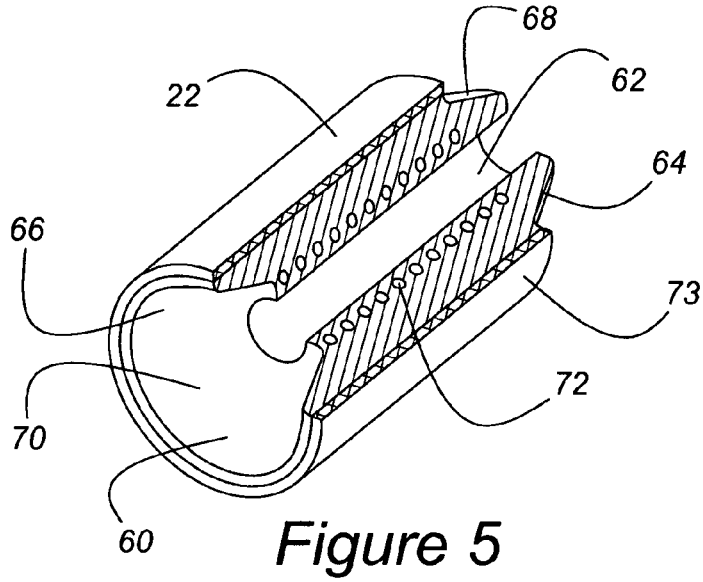
FIG. 5 illustrates a perspective and partially sectioned view of a machine nozzle set forth herein.

Referring now to FIG. 2, a sectional and detailed view of a single hot runner assembly 18 is illustrated. As noted above, the hot runner assemblies 18 are partially recessed within the cover half 14 of the casting die 12. The illustrated single hot runner assembly 18 consists of a hot runner body 26 having a long axis along which a molten metal passage 28 is formed. The hot runner body 26 includes a molten metal input end 30 and a molten metal output end 32. The molten metal input end 30 includes an outer cone 34 which can be inserted into a receiving end of the machine nozzle 22 as shown in FIG. 5 and as discussed in relation thereto.

With reference still to FIG. 2, the molten metal output end 32 includes a cavity 36 defined therein into which a hot runner tip 38 is partially positioned. The outward end of the hot runner tip 38 terminates at a part line 39 formed between the cover half 14 and ejector half 16 of the casting die 12. The hot runner tip 38 includes an end 41 that is open to the mold cavity.

The hot runner tip 38 is provided to establish thermal valving in the apparatus 10 whereby a thermal plug (shown in FIG. 4 and discussed in relation thereto) is formed at the orifice outlet of the hot runner body 26. The opening of the hot runner tip 38 may be of a variety of possible sizes, although an orifice size of about 8 mm provides an effective configuration. The objective of the hot runner tip 38 is to prevent the flow of molten magnesium downwards into the gooseneck 20 during each complete casting cycle because of the ability of the thermal plug formed adjacent the die cavity by the hot runner tip 38 to retain the pressure difference in the hot runner assembly 18 and the gooseneck 20.

The hot runner body 26 is positioned in a hot runner body cavity 40 which is recessed within the cover half 14 of the casting die 12. The hot runner body 26 is held in place by a support ring 42 which may be fastened to the cover half 14 of the casting die 12 by conventional means such as by mechanical fasteners 44 and 44'.

It is important in the operation of the apparatus 10 that the molten metal be maintained at high temperatures at all stages between the crucible 24 and the die 12. Accordingly, a series of insulators and heaters are provided to maintain the needed temperatures. To this end the hot runner assembly 18 includes both insulators and heaters. A hot runner body insulator ring 46 is fitted between the hot runner body 26 and the support ring 42. A nozzle tip insulator ring 49 is fitted between the hot runner tip 38 and the cover half 14 of the casting die 12. The hot runner body insulator ring 46 and the nozzle tip insulator ring 49 are formed from a known insulating material.

To keep the hot runner assembly 18 as uniform a temperature as possible external heaters are applied. As illustrated in FIG. 2, a pair of spaced-apart band heaters 48 and 50 is fitted to the hot runner body 26. The band heaters 48 and 50 are electrically powered and controlled in a known manner.

Figure 3:
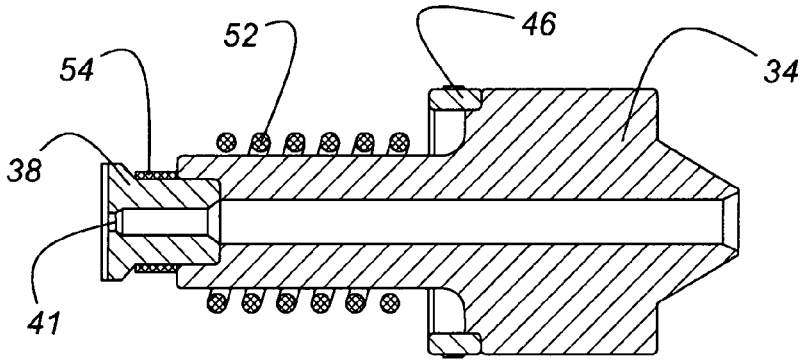
FIG. 3 illustrates a sectional view of the hot runner body of FIG. 2 illustrating an alternate arrangement for heating.

In addition or as an alternative to the use of band heaters as illustrated in FIG. 2, coil or tubular heaters may also be used to create and maintain the desired level of heat in the hot runner assembly 18. An example of such an alternative is illustrated in FIG. 3 where a coil heater 52 is fitted to the hot runner body 26 in lieu of the band heater 48. As a further modification, a hot runner tip band heater 54 is shown in FIG. 3 externally positioned on the hot runner tip 38. Other variations may be possible provided the objective of establishing and regulating the desired levels of heat with respect to the hot runner body 26 is achieved. Accordingly, the application of heat using bands and coils as shown is intended as being illustrative and not limiting.

Figure 4:
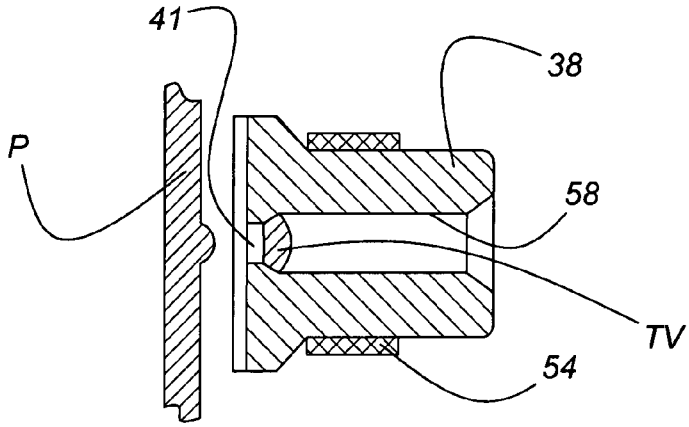
FIG. 4 illustrates a perspective and partially sectioned view of a nozzle tip set forth herein.

Referring now to the hot runner tip 38, this component is illustrated in sectional view in FIG. 4 and is shown in relation to a portion of a cast part "P". The cast part P is illustrated as having been removed from the mold cavity and thus separated from the hot runner tip 38. A molten metal passage 58 is defined along the long axis of the hot runner tip 38. The hot runner tip 38 may be threadably attached to the hot runner body 26 or may be attached by other mechanical means.

The hot runner tip heater 54 is provided to keep the hot runner tip 38 at a preselected temperature such that the metal at the end 41 may flow freely into the mold cavity during the plunger shot but will form a solid blockage once the shot is completed. Accordingly, there is a temperature differential between the end 41 and the hot runner tip 38. This temperature differential means that the area of the opening of the hot runner tip 38 into the mold cavity will be cooler than the rest of the hot runner tip 38, thus allowing the molten metal in the immediate area of the tip to cool and become solidified locally in the area of the tip. This arrangement prevents molten metal from leaking from the cavity and back into the hot runner tip 38 at the end of the shot.

The temperature differential is dependent upon the metal being used to make the cast component. By way of example, magnesium alloy (for example, AZ91) becomes solid at 470° C. and is fully molten at temperatures over 595° C. Accordingly, the temperature of the hot runner tip 38 must be such that the metal therein is molten to allow it to flow. Conversely, the temperature at the end 41 of the hot runner tip 38 that is open to the mold cavity must be cooler than that of the rest of the hot runner tip 38 and specifically must approach, but not necessarily meet, the temperature of 470° C. at which magnesium alloy is solid. Of course, the temperature of the nozzle tip 38 may be adjusted up or down depending on the metal alloy being used.

As illustrated in FIG. 4, a nozzle tip "TV" of an ideal size and configuration has been formed within the hot runner tip 38. The nozzle tip TV prevents the back-flow of molten metal into the hot runner tip 38 after the completion of the shot.

The machine nozzle 22 is illustrated in FIG. 5. A quarter of the machine nozzle 22 has been removed for illustrative purposes. The machine nozzle 22 includes a machine nozzle body 60 having a molten metal passage 62 defined along its long axis. The machine nozzle 22 also includes a molten metal input end 64 which has an outer cone 68 to mate with the gooseneck 20. The machine nozzle 22 also has a molten metal output end 66 defined as a conical cavity 70 which mates with outer cone 34 of the molten metal input end 30 of the hot runner assembly 18.

As noted above, it is important to establish and maintain desired temperatures at all points between the crucible 24 and the die 12. Accordingly, the machine nozzle 22 is also provided with a heating element. Two forms of heating elements are illustrated in FIG. 5. The first form is heating element 72 which is a coil-type heating system. The second form is heating element 73 which is a band heater. The coil, band, or tubular form of heating elements may be used, alone or in combination.

Figure 6:
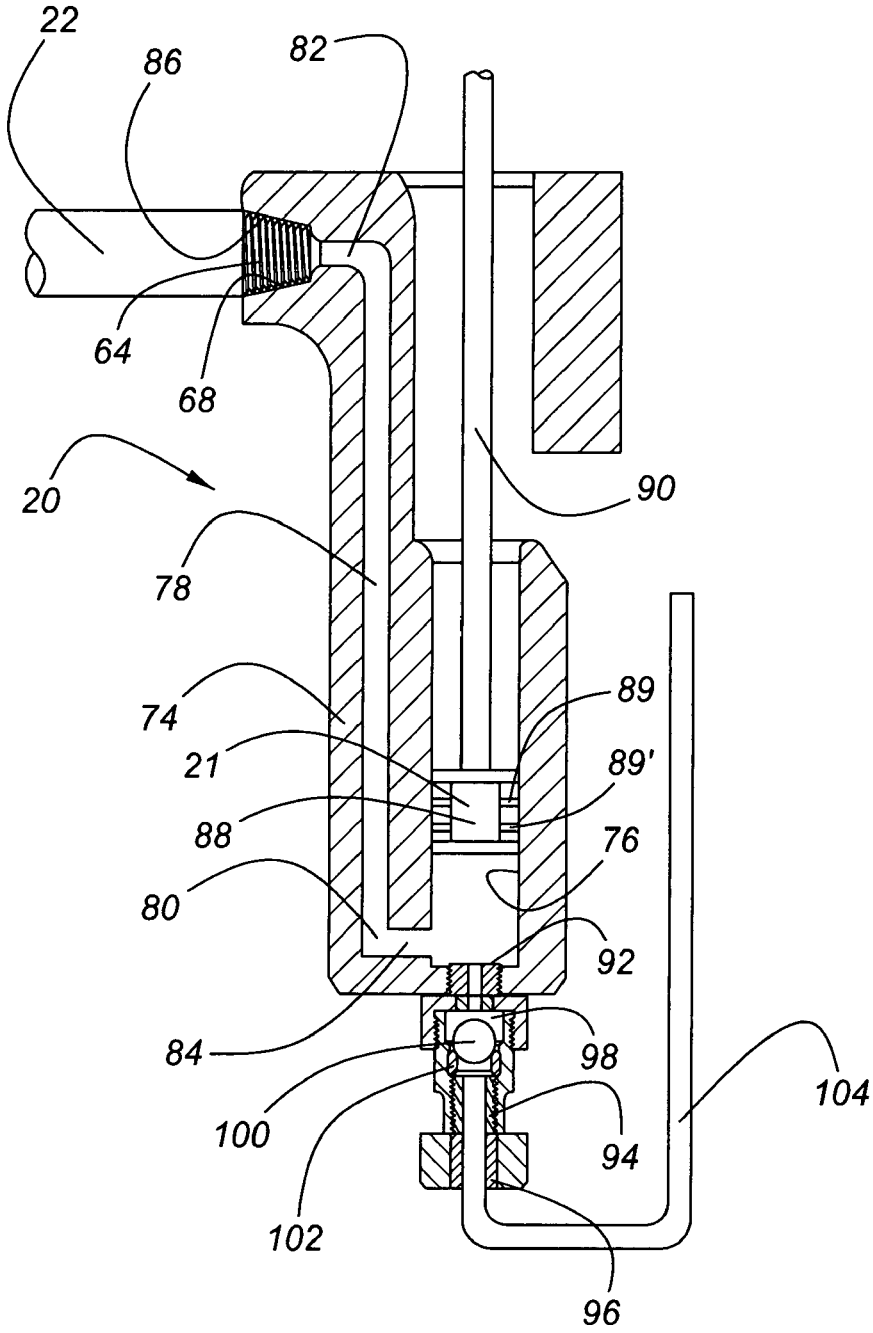
FIG. 6 illustrates a sectional view of a single plunger and check valve assembly set forth herein.

Delivery of the molten metal from the crucible 24 to the machine nozzle 22 is accomplished by the gooseneck 20. The gooseneck 20 is detailed in sectional view in FIG. 6. The gooseneck 20 may be made of a superalloy steel. The gooseneck 20 includes a gooseneck body 74 and the shot plunger 21. The gooseneck body 74 includes a plunger cylinder 76 for the shot plunger 21 and a molten metal passageway 78. The plunger cylinder 76 and the molten metal passageway 78 are substantially parallel to one another, with the diameter of the plunger cylinder 76 being larger than the diameter of the molten metal passageway.

The molten metal passageway 78 includes an inlet end 80 and an outlet end 82. The inlet end 80 is in fluid communication with the plunger cylinder 76 by way of a molten metal channel 84. The outlet end 82 terminates at a plunger molten metal outlet port 86. The plunger molten metal outlet port 86 is preferably of a conical configuration so as to mate snugly with the outer cone 68 of the machine nozzle molten metal input end 64.

The shot plunger 21 includes a piston head 88 and a plunger drive shaft 90 which selectively drives the piston head 88. The plunger drive shaft 90 reciprocates within the plunger cylinder 76. A pair of sacrificial metal rings 89 and 89' is fitted to the piston head 88. The rings 89 and 89' are sacrificial and are intended to be worn instead of the piston head 88 during operation. Accordingly, the need to replace the piston head 88 at regular intervals is avoided. The plunger drive shaft 90 is attached to a plunger drive mechanism 91 (shown in FIG. 1).

The plunger cylinder 76 includes a molten metal inlet end 92. A check valve assembly 94 is fitted to the molten metal inlet end 92 at the base of the gooseneck 20 for controlling entry of the molten metal into the plunger cylinder 76 from the crucible 24. The check valve assembly 94 is needed to make repeatable castings per casting shot by assuring that the hot runner assembly 18 and the gooseneck 20 are always filled with molten metal.

The check valve assembly 94 includes an inlet end 96 and an outlet end 98. Between the inlet end 96 and the outlet end 98 of the check valve assembly 94 is a check valve ball 100. The check valve ball 100 is shown in its closed position on a check valve ball seat 102. A molten metal inlet tube 104 is optionally though preferably fitted to the inlet end 96 of the check valve assembly 94. This arrangement allows for purer molten metal to be drawn from the crucible 24 than might be drawn from the lower end of the crucible 24.

The check valve ball 100 is movable between the illustrated closed position where the check valve ball 100 is positioned on the check valve ball seat 102 and an open position (not shown) where the check valve ball 100 is lifted off of the check valve ball seat 102. Particularly, molten metal is drawn from the crucible 24 into the plunger cylinder 76 when the piston head 88 is moved in a direction away from the molten metal inlet end 92 by suction. This action urges the check valve ball 100 to be moved from its closed position, resting upon the check valve ball seat 102, to its open, molten metal-passing position (not shown) whereupon molten metal may be allowed to pass through the check valve assembly 94 unrestricted by the check valve ball 100. Once the plunger cylinder is filled with molten metal, the piston head 88 is moved in an opposite direction, that is, it is moved toward the molten metal inlet end 92. This movement forces the molten metal against the check valve ball 100 such that it is moved against and seated upon the check valve ball seat 102. The molten metal is then forced through the molten metal channel 84, into the molten metal passageway 78, through the outlet end 82 and into the machine nozzle 22.

Figure 7:
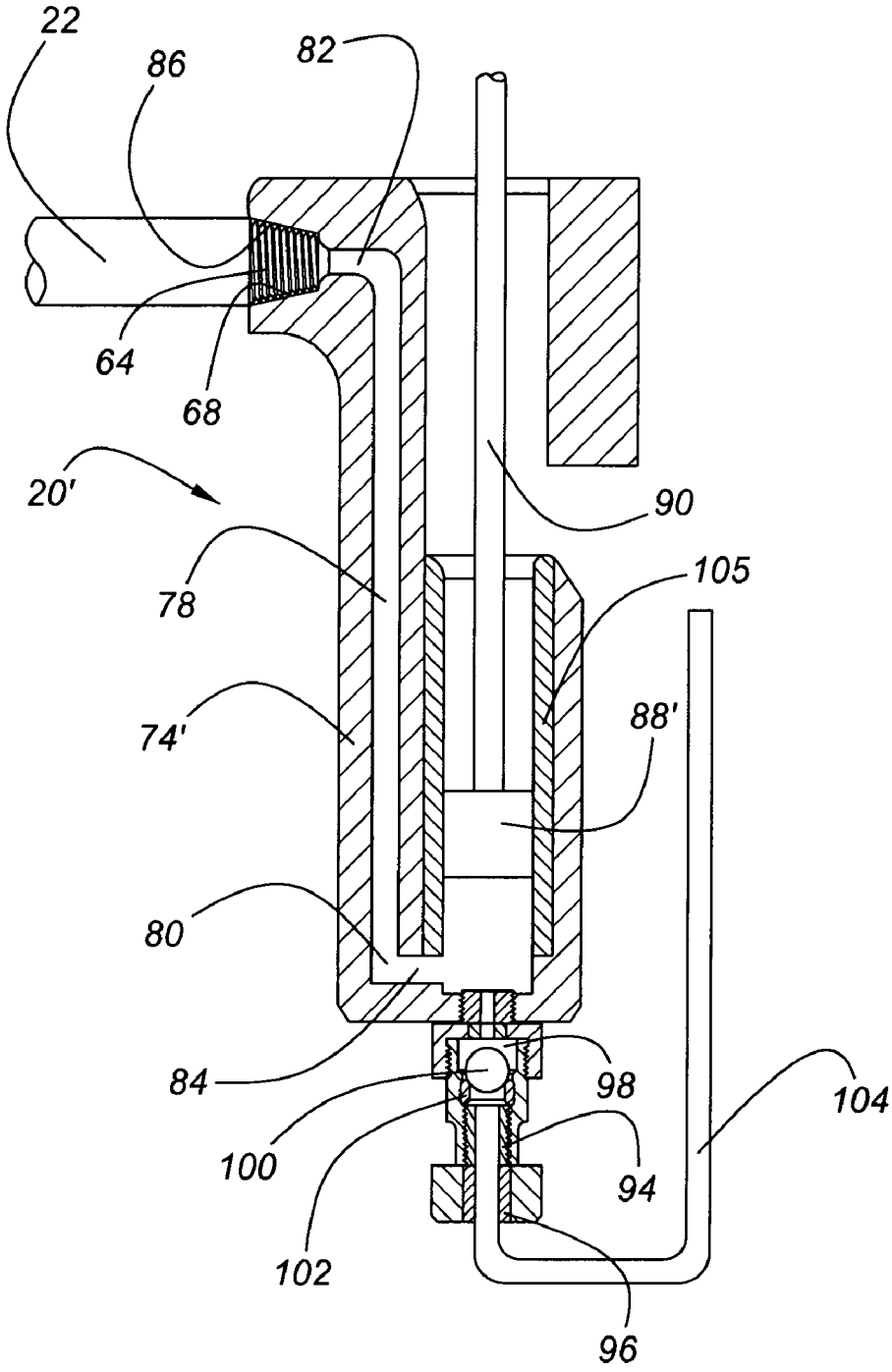
FIG. 7 illustrates a sectional view of an alternate embodiment of a single plunger and check valve assembly set forth herein.

As noted above with reference to FIG. 6, a pair of sacrificial rings 89 and 89' is provided to endure the operational wear instead of the piston head 88. This wear is the result of the metal-to-metal contact between the sacrificial rings 89 and 89' and the wall of the plunger cylinder 76. An alternative approach to the use of the sacrificial rings 89 and 89' is illustrated in FIG. 7 where a gooseneck 20' is illustrated. The gooseneck 20' includes a gooseneck body 74' and a piston head 88'. With the exception of the design and construction of the gooseneck body 74' and the piston head 88', the gooseneck 20' includes elements that are preferably identical in design and function to those of the gooseneck 20 discussed above and shown in FIG. 6. Accordingly, only the differences will be discussed.

The gooseneck body 74' is configured so as to eliminate the need of having to change sacrificial rings. Accordingly, the piston head 88' is provided without sacrificial rings. This is accomplished by use of a ceramic liner 105. The ceramic liner is a sleeve that is shrink-fitted within the gooseneck body 74'. The ceramic liner 105 may be composed of a variety of ceramic materials, but preferably is composed of a silicon nitride material such as SN-240 manufactured by Kyocera.

Other ceramic materials may be used as an alternative to silicon nitride. By using a ceramic liner in the gooseneck 20' the metal-to-metal wear of the arrangement of the gooseneck 20 is eliminated.

Regardless of whether the gooseneck 20 or the gooseneck 20' is used, once the molten metal enters the machine nozzle 22 its movement is continued by the action of the piston head 88 (or 88') through the machine nozzle 22 and into the hot runner body 26. Passing through the hot runner body 26, the molten metal next proceeds through the hot runner tip 38 and into a cavity in the die 12. This procedure represents the most fundamental aspect of the invention. The molten metal proceeds from the gooseneck 20 through to the casting die 12 with both the temperature and the rate of flow being fully controlled by external operations (not shown).

However, the method and apparatus disclosed herein may be used in more complex applications than the single injector arrangement shown in FIG. 1. Specifically, use of the present method and apparatus may be extended to larger components of varying shapes and sizes and a single manifold may be used for a variety of casting configurations. Such an alternate arrangement is shown in FIGS. 8 through 11 and is described in conjunction therewith.

Figure 8:
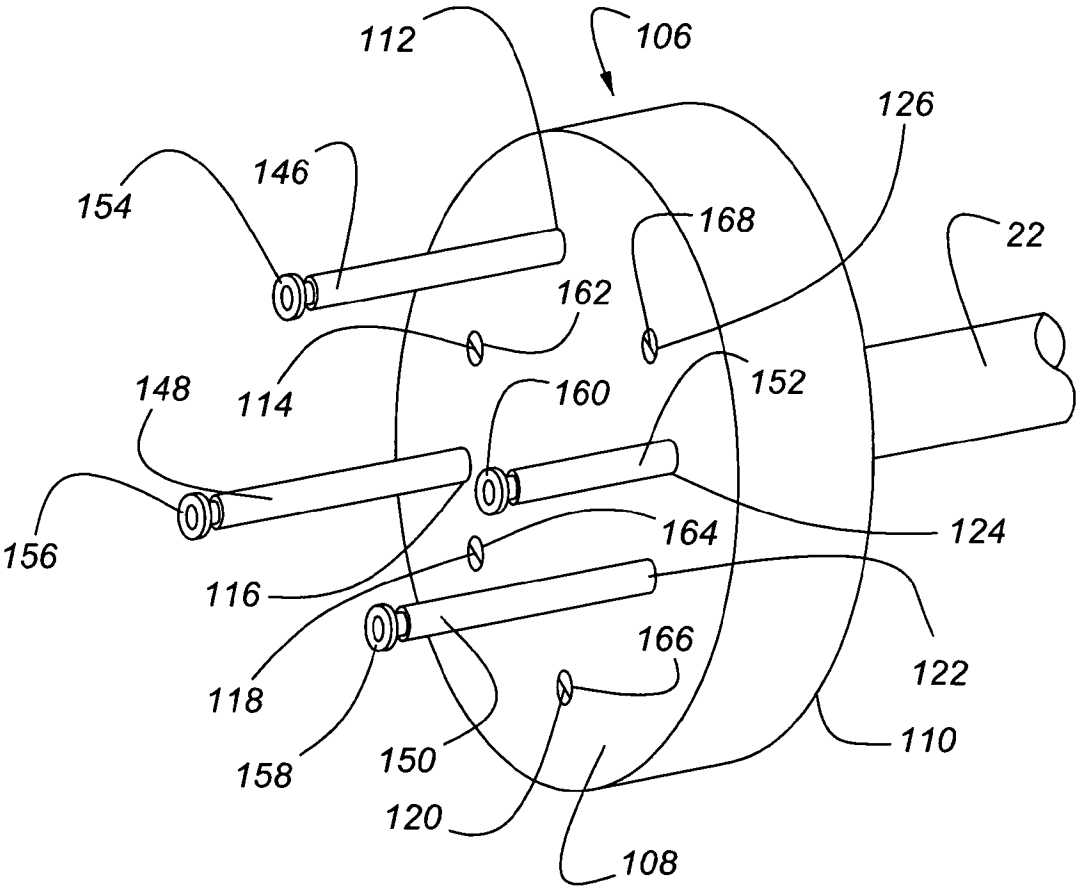
FIG. 8 illustrates a perspective view of an adaptive and universal hot runner manifold for die casting set forth herein.
Figure 9:
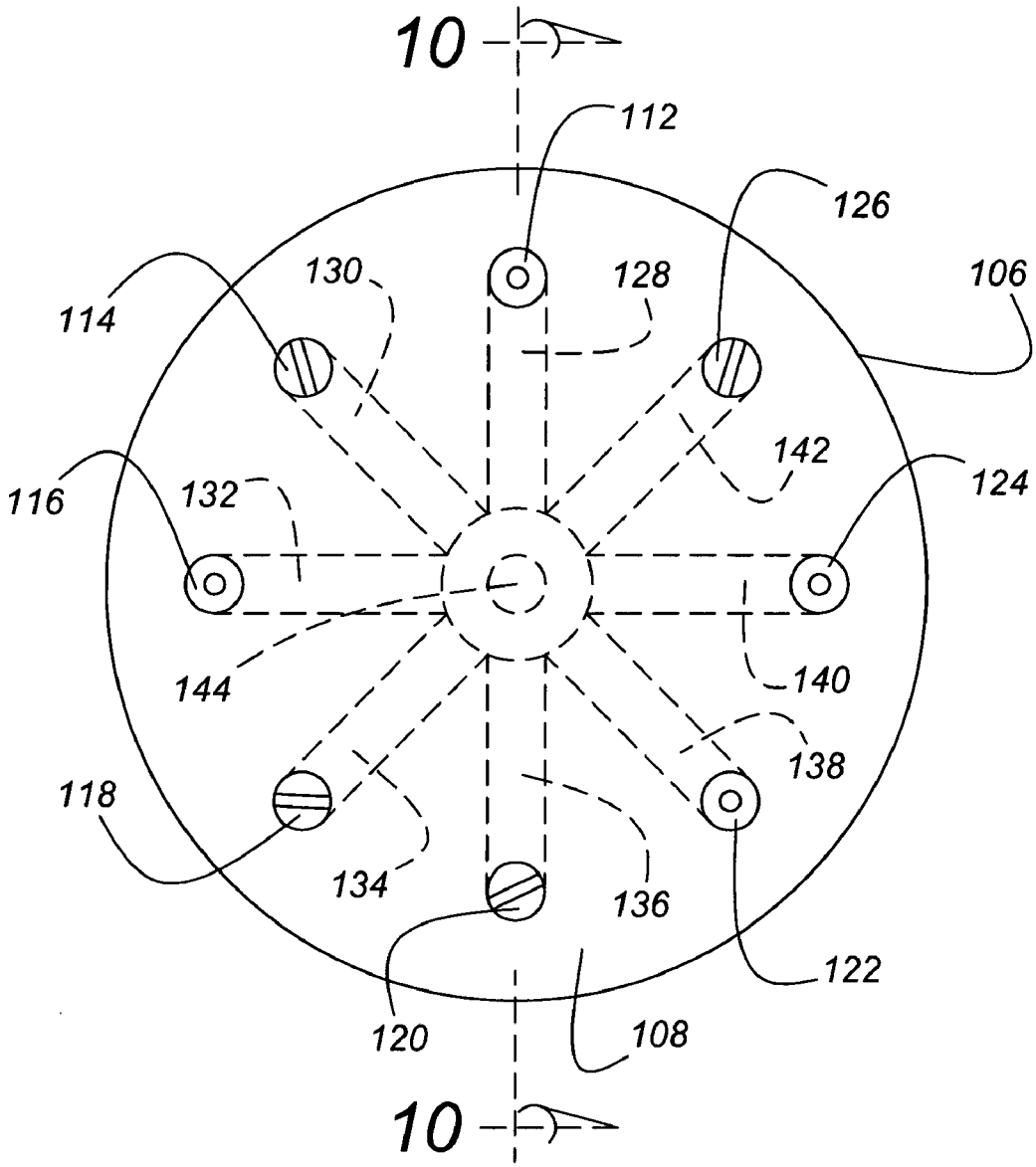
FIG. 9 illustrates a view of the molten metal output side of the manifold set forth herein.

With reference to FIG. 8, an adaptive and universal hot runner manifold according to the present invention is shown in perspective and is generally illustrated as 106. The manifold 106 includes a molten metal output side 108 and a molten metal input side 110. The machine nozzle 22 is fitted to a receptacle on the molten metal input side 110 (shown in FIGS. 10 and 11 and discussed below in relation thereto) of the manifold 106. FIG. 9 shows a plan view of the molten metal output side 108.

With reference to both FIGS. 8 and 9, the molten metal output side 108 has a plurality of molten metal ports 112, 114, 116, 118, 120, 122, 124, 126 defined therein which are fluidly connected to one another by respective fluid passageways 128, 130, 132, 134, 136, 138, 140, 142. The fluid passageways 128 . . . 142 lead from a machine nozzle input port 144 (shown in broken lines in FIG. 9). The machine nozzle input port 144 is in fluid communication with the machine nozzle 22.

A key aspect of the versatility of the manifold 106 according to the present invention resides in the adaptability of the manifold 106 to a variety of castings. This adaptability is based on the ability of the hot runner injectors to be interchanged or removed entirely and replaced with a plug to achieve cost saving, less machine downtime, and quality casting per molten metal filling pattern. Specifically, and still referring to FIGS. 8 and 9, a plurality of hot runner injectors 146, 148, 150, 152 are fitted to the molten metal ports 112, 116, 122, 124 respectively of the molten metal output side 108 of the manifold 106. The hot runner injector 146 is fitted with a nozzle tip 154. The hot runner injector 148 is fitted with a nozzle tip 156. The hot runner injector 150 is fitted with a nozzle tip 158. And the hot runner injector 152 is fitted with a nozzle tip 160.

As shown, the hot runner injectors 146 . . . 152 are not necessarily of the same length. In addition, a plurality of plugs 162, 164, 166, 168 are fitted to the unused fluid passageways 114, 118, 120, 126 respectively.

The arrangement shown in FIGS. 8 and 9 is illustrative and shows how the manifold 106 might be configured to fit a particular casting. Of course, a greater or lesser number of molten metal ports might be formed on the manifold 106. In addition, while four hot runner injectors are illustrated, a greater or lesser number of hot runner injectors might be used. The objective is to provide maximum utility of the disclosed method and apparatus for adaptation to a broad variety of castings, thus minimizing tooling and maintenance expenses.

Figure 10:
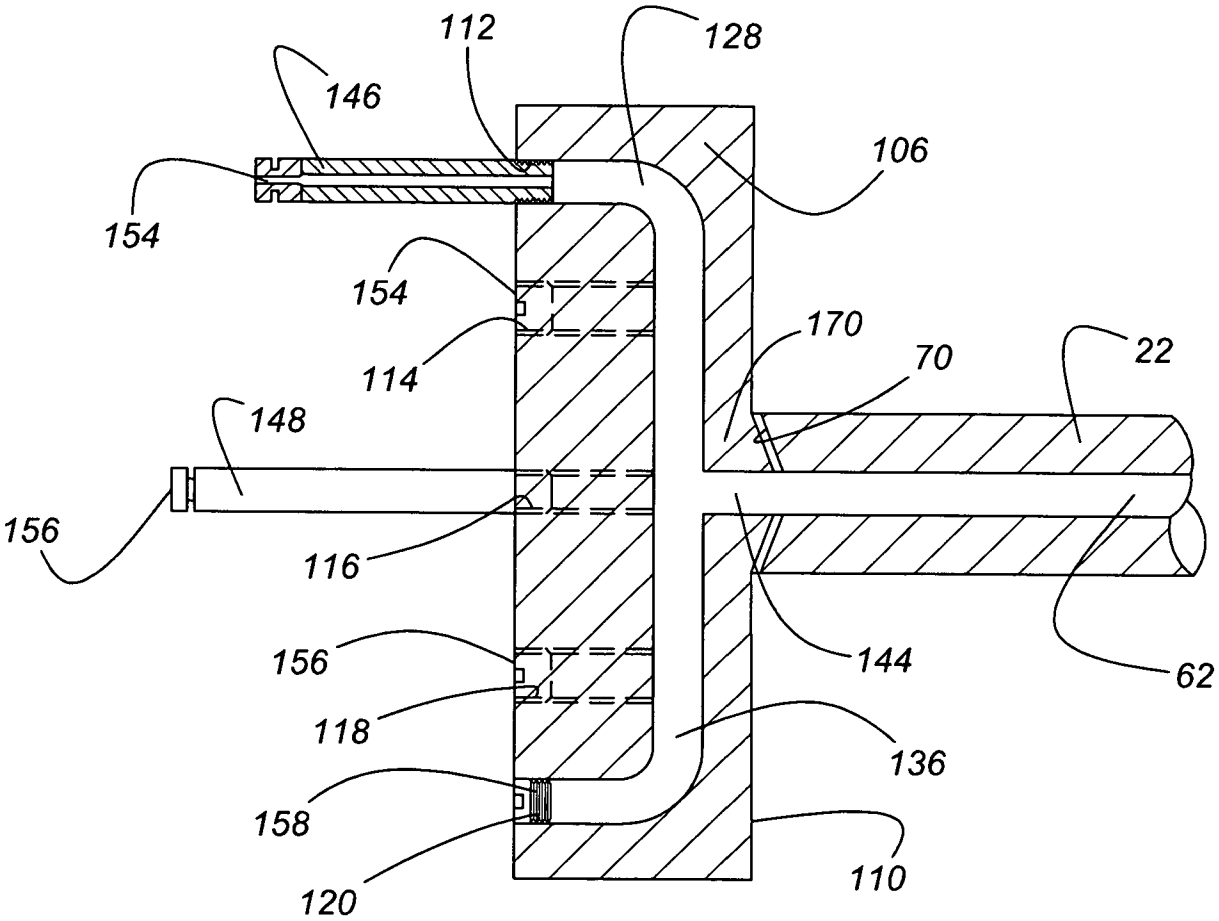
FIG. 10 illustrates a cross sectional view of the manifold set forth herein taken along lines 10-10 of FIG. 9.

A sectional view of the manifold 106 is shown in FIG. 10 which illustrates the fluid passageways 128, 136 in relation to the machine nozzle input port 144. The machine nozzle input port 144 is formed as part of a conical machine nozzle fitting 170 formed on the back side of the manifold 106. As shown in the figure, the conical machine nozzle fitting 160 snugly mates with the conical cavity 70 of the machine nozzle 22.

Figure 11:
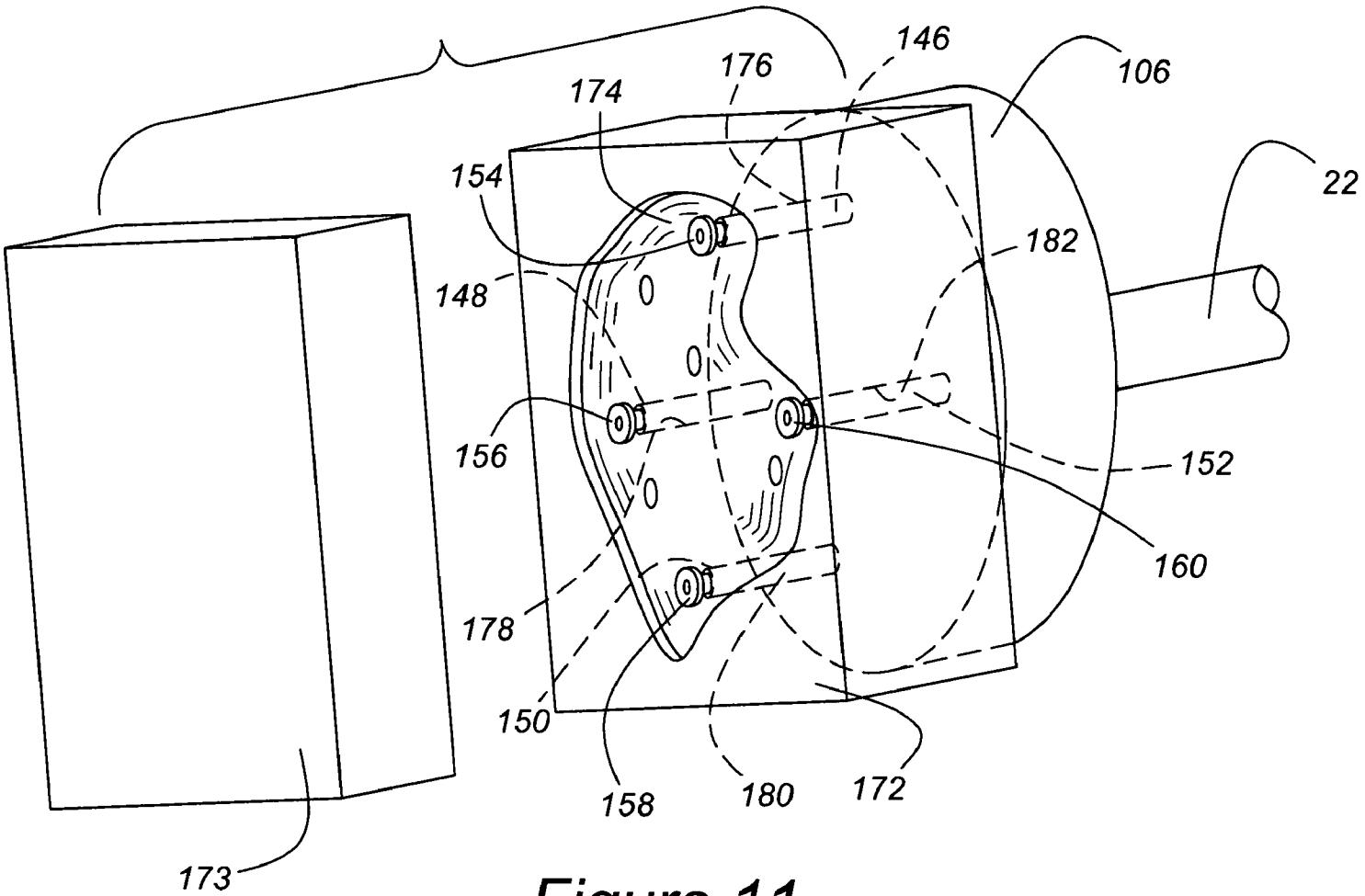
FIG. 11 illustrates a perspective view of a lower half of a casting operatively associated with the manifold and an upper half of the casting spaced apart from the lower half.

The use of the manifold 106 with a die set comprising a cover die 172 and an ejector die 173 is illustrated in FIG. 11. With respect thereto, the cover die 172 is positioned against the molten metal output side 108 of the manifold 106. The cover die 172 includes a component cavity 174 where a component (not illustrated) is cast. A series of hot runner injector-passing ports 176, 178, 180, 182 are formed through the cover die 172 into which the hot runner injectors 146 . . . 152 are respectively positioned. The openings of the nozzle tips 154 . . . 160 are disposed within the cavity 174 such that they do not actually extend into the cavity 174.

In operation, the desired number and lengths of hot runner injectors are selected based on the number and length of the hot runner injector-passing ports. The key point is to have the optimal arrangement of hot runner injectors to achieve a fine filling pattern and quality casting. Each of the selected hot runner injector is attached to the manifold 106, preferably by threading, although other measures of attachment may be used in the alternative. Plugs are inserted into the unused hot runner injector-passing ports.

The foregoing discussion discloses and describes an exemplary embodiment of the adaptive and universal hot runner manifold for die casting and method of use disclosed herein. One skilled in the art will readily recognize from such discussion, and from the accompanying drawings and claims that various changes, modifications and variations can be made therein without departing from the true spirit and fair scope of the disclosed method and apparatus as defined by the following claims.

What is claimed is:

1. A hot runner manifold assembly for use in a metal casting apparatus, the hot runner manifold assembly being positioned between a molten metal delivery component and a mold cavity of a die, the hot runner manifold assembly comprising:

a manifold body having an inlet in fluid communication with the molten metal delivery component, first and second outlets fluidly connected to the inlet via first and second passageways, respectively, and first and second hot runner connectors disposed at least partially in the first and second outlets, respectively; and a support ring having a notch disposed on the die;

wherein at least one hot runner connector includes a hot runner body disposed in the support ring and having an inlet end and an outlet end, a hot runner tip disposed next to the mold cavity and received in the outlet end, a hot runner body insulator ring disposed between the hot runner body and the notch of the support ring such that the support ring does not engage the hot runner body and does not actuate the hot runner body insulator ring, and a nozzle tip insulator ring disposed between the hot runner tip and the die, wherein the hot runner body and hot runner tip do not contact the die.

2. The hot runner manifold assembly of claim 1 wherein the hot runner tip has a first end the engages the first hot runner connector and a second end disposed opposite the first end, wherein a temperature differential is provided such that the second end is cooler than the first end to inhibit metal from flowing from the second end toward the first end.

3. The hot runner manifold assembly of claim 1 wherein the manifold body is disposed adjacent to a cover die that at least partially defines the mold cavity and the first and second hot runner connectors are disposed on the cover die.

4. The hot runner manifold assembly of claim 1 wherein the first hot runner connector has dimensions and the second hot runner connector has dimensions, the dimensions of the first hot runner connector and the dimensions of the second hot runner connector being different.

5. The hot runner manifold assembly of claim 1 including a fluid-stopping plug attachable to the first outlet.

6. The hot runner manifold assembly of claim 1 wherein the first outlet is spaced apart from the inlet at a first distance and the second outlet is spaced apart from the inlet at a second distance, the first and second distances being the same.

7. The hot runner manifold assembly of claim 1 wherein a first heater is disposed between the hot runner body insulator ring and the nozzle top insulator ring.

8. The hot runner manifold assembly of claim 1 wherein the manifold body further comprises a third outlet spaced apart from the first and second outlets and fluidly connected to the inlet via a third passageway, wherein the first, second, and third passageways extend radially from the inlet.

9. The hot runner manifold assembly of claim 8 wherein the first, second and third passageways are substantially linear.

10. An apparatus for the casting of metal in a mold cavity, the apparatus comprising:

a crucible containing a liquid metal;

a molten metal delivery apparatus including a delivery apparatus inlet and a delivery apparatus outlet, the inlet being in fluid communication with the crucible; and a hot runner manifold having an inlet in fluid communication with the delivery apparatus outlet, first and second outlets fluidly connected to the inlet via first and second passageways, respectively, and first and second hot runner connectors disposed at least partially in the first and second outlets, respectively;

wherein the first hot runner connector includes:

a first end portion;

a second end portion disposed opposite the first end portion;

a second end portion heater disposed around the second end portion;

a hot runner tip that has a first end received by the second end portion and a second end, and a hot runner tip heater disposed around and in direct contact and engagement with the hot runner tip and spaced apart from the first and second ends;

a support ring having a notch; and a hot runner body insulator ring disposed in the notch that engages the first end portion and the support ring such that the support ring does not engage the hot runner body;

wherein a temperature differential is provided between the second end and the hot runner tip heater such that the second end is cooler than the first end to form a solid nozzle tip within the hot runner tip to inhibit metal from flowing from the second end toward the first end.

11. The apparatus of claim 10 including a first hot runner injector fitted to the first outlet in fluid communication with the mold cavity and a second hot runner injector fitted to the second outlet in fluid communication with the mold cavity.

12. The apparatus of claim 11 wherein the first hot runner injector has dimensions and the second hot runner injector has dimensions, the dimensions of the first hot runner injector and the dimensions of the second hot runner injector being the same.

13. The apparatus of claim 11 wherein the first hot runner injector has dimensions and the second hot runner injector has dimensions, the dimensions of the first hot runner injector and the dimensions of the second hot runner injector being different.

14. The apparatus of claim 10 including a fluid-stopping plug disposed in the first outlet.

15. The apparatus of claim 10 wherein the first outlet is spaced apart from the inlet at a first distance and the second outlet is spaced apart from the inlet at a second distance, the first and second distances being the same.

16. The apparatus of claim 10 wherein the first outlet is spaced apart from the inlet at a first distance and the second outlet is spaced apart from the inlet at a second distance, the first and second distances being the different.

17. The apparatus of claim 10 wherein the first and second passageways extend in opposite directions.

18. A method for casting a metal part in a die cavity comprising the steps of:

forming a metal part casting apparatus comprising a crucible containing a liquid metal, a molten metal delivery apparatus, a die having a die cavity, a hot runner manifold assembly having a temperature control system and plural outlets disposed at the die cavity;

selecting plural inserts for a like number of outlets, the inserts beings elected from the group consisting of hot runner injectors and outlet plugs;

fitting the selected plural inserts into the plural outlets of the hot runner manifold assembly until all of the outlets are occupied by one of the inserts;

connecting the hot runner manifold assembly to the die by disposing a support ring having a notch on the die, and disposing a hot runner body insulator ring between the hot runner manifold assembly and the notch of the support ring;

engaging the hot runner temperature control system in the hot runner manifold assembly;

causing molten metal to flow through the metal part casting apparatus and into the die cavity to form a part; and controlling the temperature of a hot runner tip disposed at an end of the hot runner injectors to form a solid nozzle tip within the hot runner tip to inhibit the molten metal from flowing back toward the crucible;

wherein at least one outlet plug is disposed in at least one outlet.

19. The method for casting a metal part of claim 18 wherein each hot runner injector includes a hot runner tip having a first end and a second end disposed proximate the die cavity and opposite the first end, wherein a temperature differential is provided such that the second end is cooler than the first end to inhibit metal from flowing from the second end toward the first end.

20. The method for casting a metal part of claim 18 wherein the hot runner injectors include injectors having different dimensions and the step of selecting the insert includes the step of selecting the hot runner injector based upon the dimension of the injector.

* * * * *